United States Patent [19]

Beintema

[11] Patent Number: 5,000,450

[45] Date of Patent: Mar. 19, 1991

[54] TETHERED BALL BATTING PRACTICE DEVICE

[76] Inventor: John L. Beintema, 10531 Maryland Cir., Bloomington, Minn. 55438

[21] Appl. No.: 516,306

[22] Filed: Apr. 30, 1990

[51] Int. Cl.[5] ..... A63B 69/00

[52] U.S. Cl. ..... 273/26 E; 273/29 A; 273/58 C

[58] Field of Search ..... 273/26 E, 26 R, 29 A, 273/58 C, 29 R, 29 BA, 29 BC, 29 BD, 29 BU, 29 BF, 184 B, 185 D, 185 C, 196, 55 R, 55 A; 403/DIG. 9

[56] References Cited

U.S. PATENT DOCUMENTS

| | | | |
|---|---|---|---|
| 1,928,892 | 10/1933 | Hickey | 273/131 |
| 2,968,978 | 1/1961 | Wheeler | 269/130 |
| 2,976,040 | 3/1961 | Bales | 273/26 E |
| 3,637,209 | 1/1972 | Raut | 273/26 E |
| 3,663,018 | 5/1972 | O'Leary | 273/26 E |
| 4,010,950 | 3/1977 | Visockis | 273/26 E |
| 4,793,612 | 12/1988 | Hammond | 273/26 E |

*Primary Examiner*—Theatrice Brown
*Attorney, Agent, or Firm*—James W. Miller

[57] ABSTRACT

A batting practice device which comprises an elongated support arm having fastening means at one end for securing the support arm to the side of a post. The fastening means includes an elongated chain which may be wrapped around the post and has one end thereof releasably retained on the support arm against a sliding movement of the chain. The other end of the chain is connected to a bolt which may be drawn through a handle as the handle is rotated to tighten the chain against the post. A ball is suspended from the support arm by an eyelet containing cord to serve as a target for batting practice. A handle which is releasable by hand holds the ball on a reduced diameter stud member at a free end of the support arm.

15 Claims, 2 Drawing Sheets

TETHERED BALL BATTING PRACTICE DEVICE

TECHNICAL FIELD

The present invention relates to a device for teaching and practicing batting skills used in baseball, softball or any other sports which require hitting a ball.

BACKGROUND OF THE INVENTION

Certain sports require the player to hit or strike a moving ball. Baseball and softball are the best known sports of this type. The batter is required to hit a pitched ball with an elongated bat. However, certain other sports, such as tennis or badminton, have similar skill requirements, i.e. a moving ball is struck by a racquet rather than a bat.

Certain machines are known which throw a ball at a batter standing some distance away, such as the batting machine known as The Casey. These batting machines are, in effect, mechanical pitchers. While they effectively simulate a thrown ball, they have a number of disadvantages which render them impractical for many applications. They are costly to purchase and bulky to transport. They require electricity to operate, and this is not always available at many locations, such as ball fields, where the device would often be used. In addition, the balls hit by the batter must be recovered or "shagged" for the machine to be refilled The machine is not suited for indoor use in a person's home.

Besides automated batting machines, batting skills are practiced using static "tees" which tee or hold the ball up above ground level. The batter stands next to the tee and attempts to strike the stationary ball held on the tee. Again, the balls must be continually shagged or recovered to allow practice to continue. This renders tees impractical for a single person to use since the task of recovering the balls quickly becomes tiresome. In addition, tees cannot generally be used indoors unless a net is positioned in front of the tee to catch the batted balls. Again, this it makes it impractical or inconvenient to use the device in restricted indoor spaces.

Thus, there is a need for a batting practice device which is simple and quick to install which is durable which may be easily adjusted, and which does not require shagging of batted balls. Most ball fields have numerous vertical posts or poles, i.e. the poles used as part of the backstop or the fence poles used in the chain link fences surrounding the fields. In addition many residential neighborhoods have similar poles. For example, there are poles supporting street signs, stop signs, etc. Thus a device which could be easily attached to a pole would be valuable and could be widely used if the ball were connected to it in a tethered manner.

Various batting practice devices comprise elongated arms attached to poles which suspend a ball from the arm in a tether type fashion. Such devices are shown in U.S. Pat. No. 2,976,040 to Bales and U.S. Pat. No. 4,793,612 to Hammond. In Hammond, the support arm is attached to a backboard having an elongated channel at its rear side for abutting against a post. U-shaped bolts pass around the post and through the backboard where wing nuts are tightened on each leg of the bolts to hold the device on the pole. Bales discloses using two radiator type clamping bands, i.e. clamping bands having overlapped ends and a screw tightener, which pass around the post and must be tightened to hold the device to the post.

The Hammond and Bales devices are relatively difficult and time consuming to mount. The Hammond device has to be held in place while the U-bolts are inserted from the back and the wing nuts tightened. This can be quite difficult for one person to do and, as a practical matter, may require two people. The Bales device requires one end of each clamping member to be removed from the threaded fastener to allow the clamping member to be looped around the post. Then, the clamping member has to be rethreaded back into the fastener and the fastener has to be tightened using a screw driver all while trying to hold the device in place at a selected height Again, this is very difficult for one person to do easily or properly. The same relatively cumber some procedures have to be followed to adjust the height of the device on the pole.

In addition, the Hammond and Bales devices both have relatively complicated systems for suspending the ball from the support arm. They both teach suspending the ball from rotary discs that are held on the end of the support arm by conventional nuts. These nuts have to be tightened using a wrench, and such wrenches may not always be at hand or be easily manipulable by a youngster who might be trying to in stall the device. In addition, if one desires to replace one ball with a ball of another type on the end of the support arm, the nut must be loosened every time a replacement is made and then retightened again. Hammond discloses using spring clips on the end of his rotary disc to engage an eyelet on the end of the ball supporting rope or cord to ease the task of changing balls. However, these spring clips can again be difficult for a youngster to unclip, especially if the device has been left outside and the clip has become corroded.

SUMMARY OF THE INVENTION

Accordingly, one aspect of this invention is to provide a batting practice device which can be quickly and easily installed on a post or pole.

Accordingly, a batting practice device according to this invention comprises an elongated support arm which may be abutted against a generally vertical post. The support arm has fastening means for securing the support arm to the post in a cantilever manner. The fastening means comprises a flexible elongated fastening member suited to extend from the support arm out around the post and back to the support arm. In addition, means are provided on the support arm for looping the fastening member around the post and for tightening the fastening member to the post using one hand only while the other hand holds the support arm up against the post, whereby the batting practice device may be installed on a post by a single person. Finally, the batting practice device includes means for suspending a ball from the support arm to allow the ball to serve as a target for a user attempting to hit the ball.

In addition, another aspect of this invention relates to an improved ball suspension means for use with the support arm. Such a ball suspension means comprises an elongated cord having one end secured to the ball. An eyelet is located at the other end of the cord. An outwardly extending stud member is located at a free end of the support arm. The stud member has an inner, smooth cylindrical bearing surface and an outer threaded portion, wherein the eyelet is suited to be received on the bearing surface for rotation of the ball and cord in a vertical plane there around. Finally, the suspension means includes a fastening member threaded onto the outer threaded portion of the stud for releasably holding the ball and cord on the stud member. The fastening member is provided with a plurality of outwardly extending wings to allow the fastening member to be tightened and untightened by hand.

BRIEF DESCRIPTION OF THE DRAWINGS

The present invention will be described hereafter in the Detailed Description, taken in conjunction with the following drawings, in which like reference numerals refer to like elements or parts throughout.

DETAILED DESCRIPTION

Figure 2:
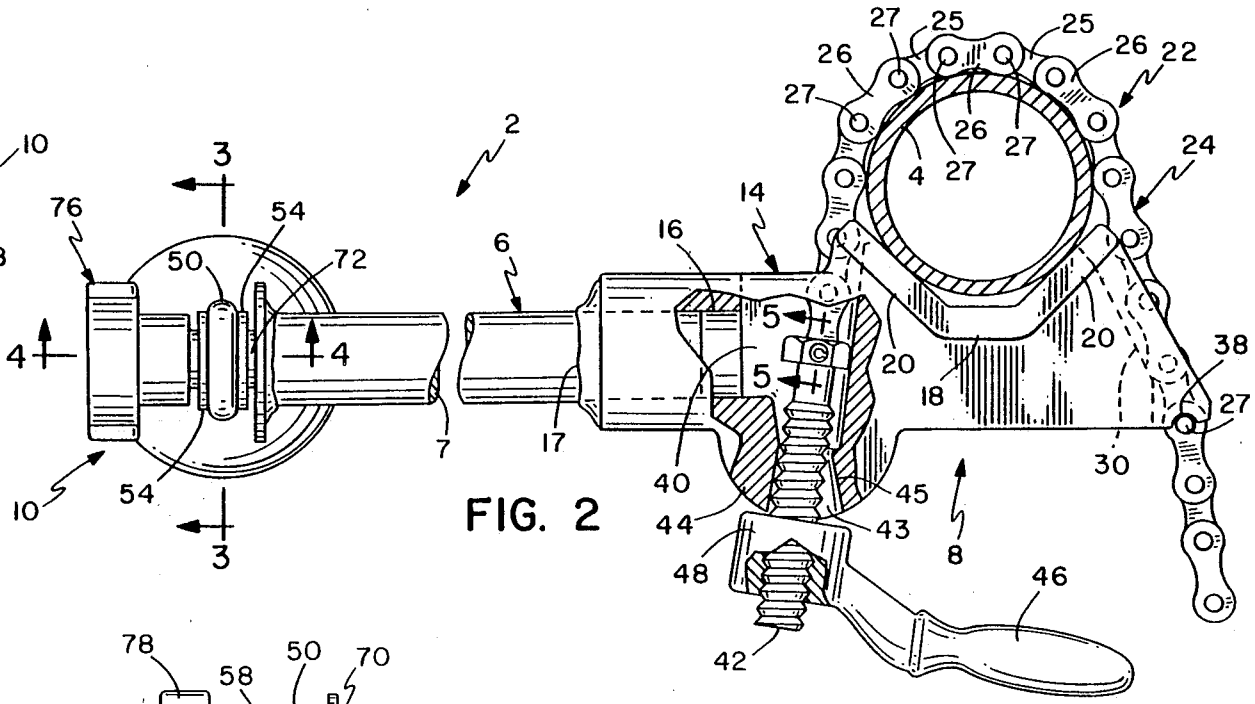
FIG. 2 is a cross-sectional view of the batting practice device shown in FIG. 1 taken along lines 2—2 in FIG. 1, with the support arm having been cut away to shorten the length of the support arm as depicted in FIG. 2.
Figure 6:
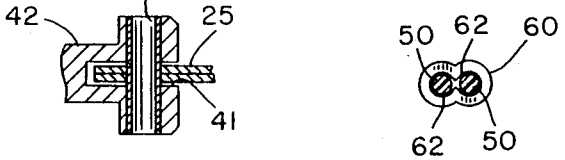
FIG. 6 is a cross-sectional view of a portion of the ball suspension means taken along lines 6—6 in FIG. 3, particularly illustrating the clasp positioned beneath the eyelet.
Figure 1:
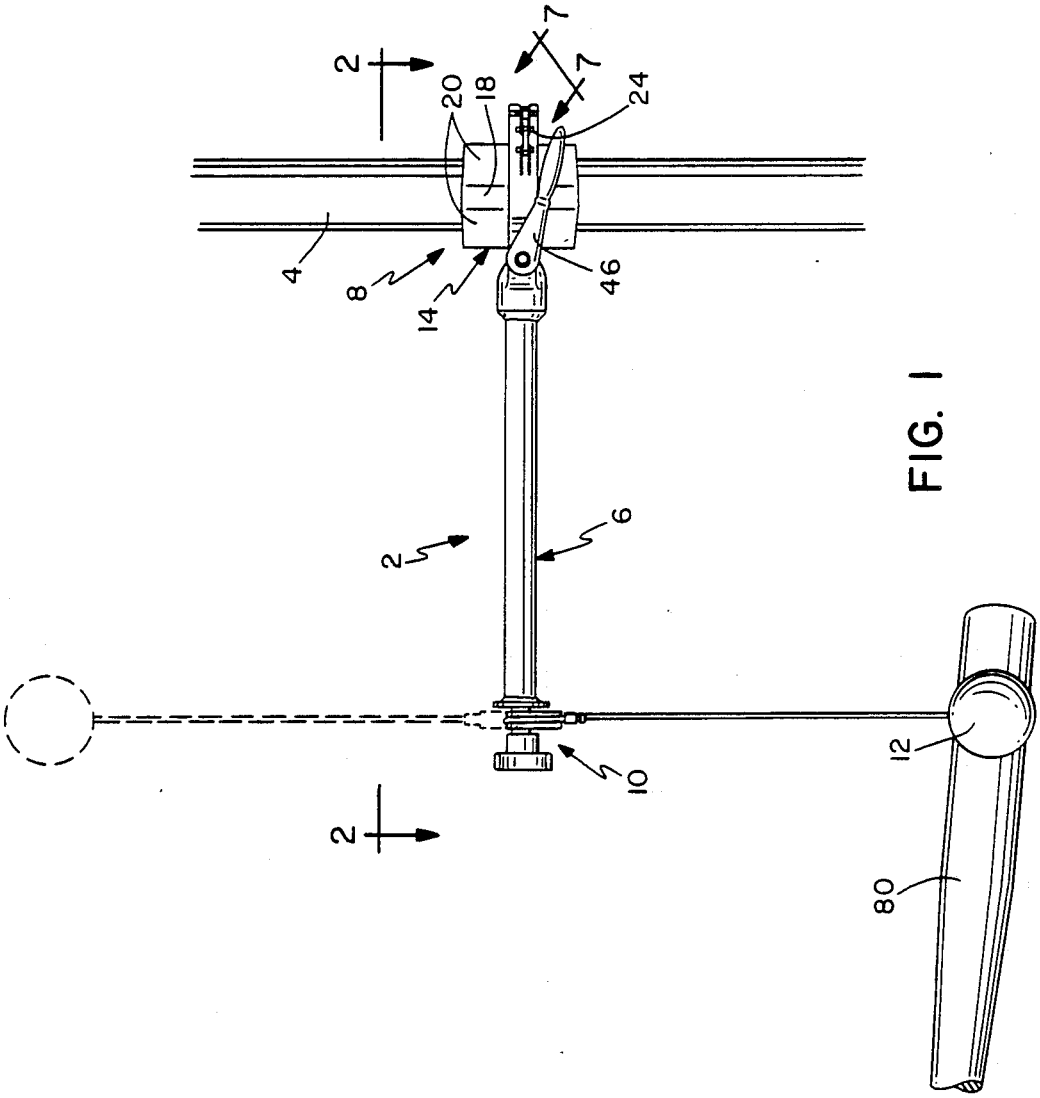
FIG. 1 is a perspective view of an improved batting practice device according to the present invention, particularly illustrating the device having been attached to a support post and a bat being used to hit the ball suspended therefrom.

The batting practice device of this invention is illustrated generally as 2 in FIGS. 1 and 2. Device 2 is adapted for being mounted to a vertical upright, such as a cylindrical pole or post 4. Post 4 could be one of the sup port posts 4 for a backstop at a baseball or softball field, or one of the fence posts 4 used in a chain link fence around the field. Alternatively, post 4 could be one of many posts 4 found in residential neighborhoods, e.g. a post used to support street or traffic signs posts used on jungle gyms or playsets, etc. Thus device 2 is not limited for use with a specific type or diameter of post 4, and post 4 could have other than a circular cross-section.

Referring to FIGS. 1 and 2, batting practice device 2 comprises an elongated support arm 6. One end of support arm 6 has fastening means, illustrated generally as 8, for mounting arm 6 to post 4 in a cantilever manner When so mounted, arm 6 extends horizontally away from post 4 by a distance determined by the length of arm 6. The other end of arm 6 has a ball suspension means 10, illustrated generally as 10, for suspending a ball 12 beneath support arm 6 as shown in FIG. 1. In this position, ball 12 serves as a target for a batter.

The Support Arm

Support arm 6 can have any suitable length as long as ball 12 is spaced away from post 4 by a suitable distance. In addition, arm 6 can have various configurations. However, support arm 6 preferably comprises a cylindrical hollow, shaft 7 made of a strong and durable material, such as steel. While materials other than steel could be used to form support arm 6, it is important that a strong material be used to enable device 2 to withstand the inevitable wear and shocks it will receive during use of device 2.

The Fastening Means

Fastening means 8 is included in an end piece 14 integrally fixed to one end of support arm 6 such that end piece 14 forms, in effect, that end of support arm 6. End piece 14 includes an elongated hollow bore 16 at one end into which shaft 7 is telescopically inserted. Shaft 7 is then welded to end piece 14 as shown at 17, or otherwise securely fixed thereto in any suitable manner Like shaft 7, it is desirable that end piece 14 be cast from or machined out of a durable and strong material, such as steel.

End piece 14 has a generally U-shaped saddle 18 on a front face thereof. Saddle 18 has two spaced, opposed wings 20 suited to allow saddle 18 to be abutted against one side of post 4 with one wing 20 being tangent to one section of post 4 and the other wing 20 being tangent to an opposed section of post 4. See FIGS. 2 and 7. Basically, saddle 18 is simply shaped to conform to one side of post 4, and the shape of saddle 18 could obviously be varied depending on the cross-sectional configuration of post 4. The saddle 18 simply helps abut that end of support arm 6 against post 4.

Fastening means 8 includes a flexible, elongated fastening member 22 which extends outwardly from end piece 14 and back to end piece 14 after first being looped around post 4. See FIG. 2. Various forms of fastening member 22 could be provided, but one preferred form is a conventional wrench chain 24. Chain 24 includes adjacent link pairs 25 and 26 pivotally secured together by pivot pins 27. Alternating link pairs vary in thickness from a first thinner link pair 25 in which the links are placed face to face to a second thicker link pair 26 in which the links are spaced apart to allow a thinner link pair 25 to be nested therebetween. This variation in the thickness of the link pairs 25 and 26 is useful in retaining one end of chain to end piece 14 as will be described hereafter.

Fastening means 8 also includes means for releasably retaining a first end of chain 24 on end piece 14 to prevent chain 24 from sliding relative to end piece 14, and hence support arm 6, along its length This retaining means comprises an open faced slot 30 on an outer side face 32 of end piece 14. Slot 30 extends through one wing 20 of saddle 18 and along the length of side face 32. Slot 30 is formed with an abutment means defined by a narrowed section 34 of the slot located at the junction of side face 32 and a rear face 36 of end piece 14. See FIG. 7.

Figure 7:
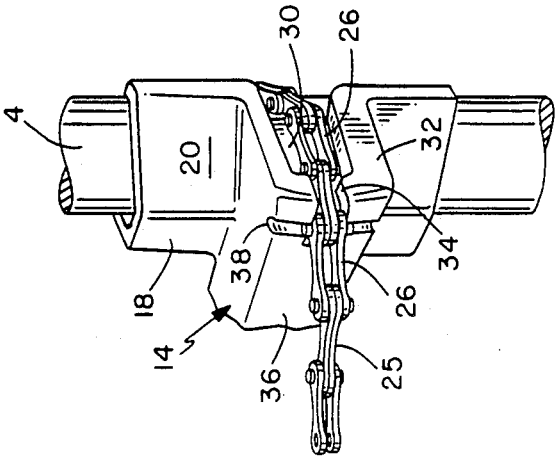
FIG. 7 is a perspective view of one end of the support arm of the batting practice device taken along lines 7—7 in FIG. 1, particularly illustrating the slot into which the free end of the chain is placed for retaining the chain from sliding relative to the support arm when it is tightened thereon.

As shown in FIG. 7, slot 30 is sized so that the first end of chain 24 may simply be laid or pulled from the side into slot 30. Chain 24 is placed into slot 30 such that a thinner link pair 25 is received in the narrowed slot section 34 with a thicker link pair 26 being received on either side of section 34, i.e. in the wider section of slot 30 and extending out from the rear face 36. Thus, any force along the length of chain 24 tending to pull chain 24 through slot 30 will be resisted since the wider link pair 26 adjacent rear face 36 cannot pass through narrowed slot section 34. Preferably, rear face 36 is also provided with a vertical groove 38 for receiving the link pin 27 at the rear of link pair 25 received in narrowed slot section 34. This further helps retain chain 24 loosely in place while resisting any sliding movement of chain 24 along its length.

Finally, fastening means 8 includes a means for allowing the other end of chain 24 to be tightened on end piece 14 and for holding that end of chain 24 in its tightened condition. Thus, the other end of chain 24 passes through a slot in the other wing 24 of end piece 14 and inwardly into an interior enlarged chamber 40 in end piece 14. The chain end is fixed to the head of a threaded bolt 42 received in chamber 40 which bolt 42 extends out through a rounded boss 44 on rear face 36 of end piece 14. A manually rotatable handle 46 has a threaded hub 48 received on the end of bolt 42. Hub 48 bears against rounded boss 44 so that rotation of handle 46 will draw chain inwardly relative to end piece 14, and hence support arm 6, by drawing bolt 42 through hub 48. This operation will be described in more detail hereafter.

Bolt 42 passes through a passageway 43 in boss 44 which passageway 43 has a tapered wall 45 that forms a non-passageway parallel side of passageway 43. The purpose of tapered wall 45 is to accommodate the changing orientation of bolt 42 in passageway 43 caused by wrapping chain 24 around posts 4 of different diameters. For example, if post 4 were significantly larger than the post illustrated in FIG. 2, then bolt 42 would pass through passageway 43 in a more nearly vertical orientation from the inclined orientation shown in FIG. 2. This change in the bolt orientation is allowed by tapered wall 45, and by enlarged chamber 40, without putting stress on bolt 42 or causing the bolt to bind in chamber 40 or passageway 43.

Figure 5:
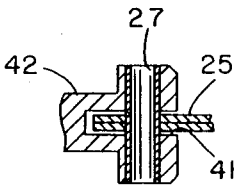
FIG. 5 is a cross-sectional view of one end of the sprocket chain as shown in lines 5—5 of FIG. 2, particularly illustrating the attachment of that end of the sprocket chain to the threaded bolt.
Figure 4:
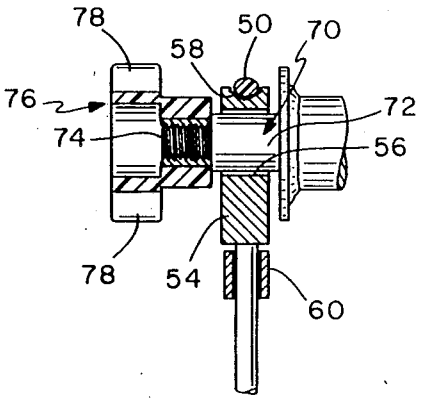
FIG. 4 is a cross-sectional view of the ball suspension means taken along lines 4—4 in FIG. 2.

Chain 24 can be fixed to bolt 42 in any suitable manner. However, as shown in FIG. 5, a thinner link pair 25 is used at that end of chain 24. This thinner link pair 25 is inserted into a slot 43 in the head of bolt 42. The normal link pin 27, or any other suitable pin or rivet, can then be inserted downwardly through a drilled passage in the bolt head and through the usual pivot holes in the end of link pair 25 to secure chain 24 to bolt 42.

The Ball Suspension Means

Figure 3:
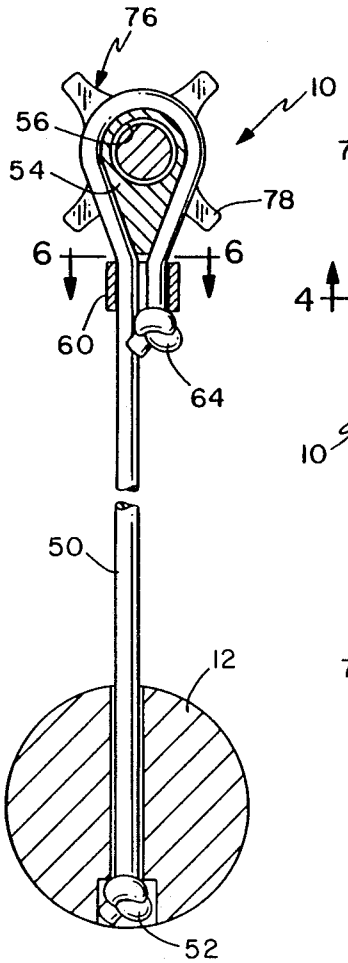
FIG. 3 is a cross-sectional view of the batting practice device shown in FIG. 1, taken along lines 3—3 of FIG. 2, particularly illustrating the means for suspending the ball from the end of the support arm.

Ball suspension means 10 at the other end of support arm 6 comprises a ball 12 which is attached to a flexible rope or cord 50. As shown in FIG. 3, ball 12 is drilled to allow cord 50 to pass through ball 12. One end of the drilled passage is enlarged to allow a knot 52 on the end of cord 50 to retain ball 12 on cord 50. A washer could be placed if desired between knot 52 and ball 12.

The other end of cord 50 is secured to a pear shaped metallic eyelet 54 having a circular hole 56 in the body thereof and a peripheral groove 58 extending around the sides thereof. A clasp 60 in the form of a figure eight is located immediately beneath eyelet 54 and includes two circular passages 62 set side-by-side. Cord 50 passes upwardly from ball 12 through a first one of the clasp passages 62, is inserted in groove 58 around eyelet 54, and then passes back downwardly through the other clasp passage 62. A knot 64 is then placed on the end of cord 50 beneath clasp 60 to hold ball 12, cord 50, eyelet 54 and clasp 60 together as an assembled unit.

Ball suspension means 10 further includes a reduced diameter threaded stem 70 extending outwardly from the free end of support arm 6. Stem 70 has a smooth cylindrical bearing portion 72 and an outer threaded end 74. Eyelet 54 of ball 12 can be slipped onto bearing portion 72 until it is adjacent the junction between stem 70 and shaft 7. The width of eyelet 54 is somewhat less than the width of bearing portion 72. Then, a threaded handle 76 is hand tightened onto threaded end 74 of stem 70 to hold the ball and cord unit in place.

Threaded handle 76 is similar to a wing nut in that it can be tightened and untightened by hand. No special tools are required. Preferably, handle 76 includes an outer portion having four outwardly extending wings 78 which the user's fingers can grip to turn handle 76. Handle 76 is sized to fit comfortably in the palm of the user's hand. However, the exact number of wings 78, and their size and placement can obviously vary.

Various types of balls could be used on cord 50 depending on the sport which it is desired to practice, e.g. a baseball, a softball, a tennis ball etc. In fact it is preferred that various cord 50 and ball 12 units be preassembled so that a change from one type of ball to another may be quickly and easily accomplished. This operation will be described in more detail hereafter.

In addition, a relatively stiff rod rather than a flexible cord 50, could be suitably secured to eyelet 54 to suspend ball 12 from support arm 6. In this event clasp 6 would not be used and the lower end of such a rod would be secured to ball 12 using a threaded nut.

Installation and Operation

Considering now the installation and operation of device 2, it is assumed that device 2 will be installed on a suitable post 4. After selecting such a post 4, e.g. a post 4 supporting a street sign, the user holds device 2 against post 4 supporting it with one hand underneath support arm 6 until saddle 18 abuts against one side of post 4. After device 2 is so placed, the user uses his other end to grab the free end of chain 24, to loop chain 24 around post 4 and to insert chain 24 into slot 30 until a thinner link pair is received in the narrowed slot section 34 as shown in FIG. 7. Then, the user can simply use the same free hand to rotate handle 46 in a direction drawing chain 24 inwardly into end piece 14 to tighten chain 24 on post 4. The user keeps tightening chain 24 by rotating handle 46 until chain 24 is firmly gripped on post 4. Then the user can stop supporting device 2 with his first hand. Device 2 will then be supported on post 4 in a cantilever manner as shown in FIG. 1

Once device 2 is installed in this fashion and a ball 12 is suspended from support arm 6, device 2 will be available for batting practice. Device 2 is preferably positioned high enough on post 4 so that ball 12 will be in an appropriate hitting zone for the height of the batter The batter can simply swing his bat 80 at the suspended ball 12 to improve his eye/hand coordination. When the batter makes contact, ball 12 will travel upwardly in a vertical plane around support arm 6 as shown in phantom lines in FIG. 1. After ball 12 comes to rest and hangs downwardly again, the batter can take another swing at it.

As noted before, various ball and cord units are preferably pre-assembled to have different types of balls 12 at the end of cord 50 or to have different cord lengths.

Because of the easily releasable handle 76, most users, even a youngster using device 2, can quickly remove one ball unit and replace it with another, i.e. take off the baseball and insert a softball. All the user has to do is untighten handle 76 until it comes off stem 70, lift off the first ball unit by sliding its eyelet 54 off stem 70, insert another ball unit by sliding its eyelet onto stem 70, and then retighten threaded handle 76. This is a simple and cost effective way of suspending ball 12 from support arm 6 and being able to easily switch from one ball to another without using special tools such as wrenches. In addition, eyelet 54 rotates around bearing portion 72 of stem 70 with a minimum of friction due to the interengaging smooth bearing surfaces used between on stem 70 and eyelet 54.

A batting practice device 2 according to this invention has numerous advantages. It can be easily installed by a single person without using any tools of any type. Thus, device 2 can be quickly and easily installed by a single parent or a youngster wishing to used the device. Readjustment of device 2 on post 4 to vary its height is similarly easily accomplished. In addition, chain 24 securely and firmly grips device 2 to post 4, and device 2 will not slip when chain 24 is tightened.

In addition, device 2 can be installed on a variety of posts 4 having different diameters and shapes, and is particularly easy to install on posts 4 despite their height as device 2 mounts from the side. In fact, device 2 can be installed on fence posts 4 in which one side is obstructed by a fence since there is usually enough of a gap to thread chain 24 between post 4 and the fence. In this case, saddle 18 is abutted against that side of post 4 away from the fence and chain 24 is simply slipped between the fence and post 4 before it is laid into slot 30. Obviously chain 24 is made sufficiently long to be adaptable to mounting on posts 4 having widely different diameters.

Various modifications of this invention will be apparent to those skilled in the art. For example, many flexible, elongated fastening members could be used in place of chain 24. For example, a fixed length cable could be secured at one end to bolt 42 and extend around post 4 to pass through slot 30. Such a cable is preferably one which would not stretch during use. The end of such a cable would be provided with a knot, or some other enlarged abutment, which would abut against the rear face 34 of end piece 14 much the same way the thicker link pair 26 abuts against that face. Then, when handle 46 is rotated, the rope will be tightened on post 4.

In addition, with some elongated fastening members the positive tightening provided could be dispensed with as long as the member could be tightened on end piece 14 and held in that position. For example the end of a cable could simply pass through chamber 40 and out through rear face 34. This cable could pass through a sailboat type cleat contained in chamber 40 or on rear face 34. Thus, after the first end of the cable is inserted into slot 30, the other end of the cable could be pulled by hand through chamber 40 and then cleated off in the cleat in the same manner as a sail line is cleated in a sailboat cleat.

Figure 8:
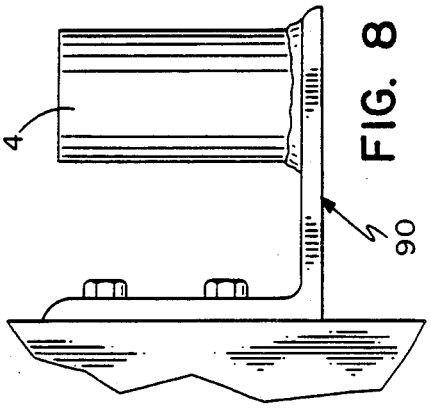
FIG. 8 is a side elevational view of a bracket that may be used with the batting practice device shown in FIG. 1, the bracket being suited for attachment to a wall for providing a post section where none is otherwise available.

Batting practice device 2 can also be used indoors in the winter if there is a suitable post 4 to attach it to and there is enough clearance to swing a bat at the ball. Since ball 12 is tethered to support arm 6, there is no need to shag balls. If no suitable post 4 is present in the house or basement thereof, then an L-shaped bracket 90 as shown in FIG. 8 could be bolted to a wall. The horizontal leg of this bracket 90 is provided with a length of vertically extending pipe to form a suitable post 4 onto which device 2 could be attached.

In using bracket 90, the post 4 provided thereby is mounted at a fixed height. Thus, support arm 6 when attached to the post is also at a relatively fixed height making it difficult to adjust support arm 6 vertically on post 4 unless post 4 is relatively long, which is un desirable from an aesthetic viewpoint. Thus, a plurality of ball and cord units could be provided having different lengths of cord 50 for suspending balls 12 at various heights. Thus, height adjustment would be accomplished by installing a ball and cord unit on the end of support arm 6 which is selected so that ball 12 is at the right height.

Various other modifications of this invention will be apparent to those skilled in the art. Thus, the scope of this invention is to be limited only by the appended claims.

We claim:

1. A batting practice device, which comprises:

(a) an elongated ball suspension support arm of predetermined length for abutting engagement against a generally vertical post, wherein the support arm has mounting means at one end of said support arm for securing said arm to the post in a cantilever manner, wherein the mounting means comprises:

(i) a flexible member having one of its ends adjustably attached to said support arm and a portion thereof extending from the support arm around the post and back to the support arm;

(ii) fastening means on the support arm for releasably engaging the other end of said flexible member; and (iii) tension adjusting means attached to said flexible member one end for tightening the flexible member to the post using one hand only while the other hand holds the support arm up against the post, whereby the batting practice device may be installed on a post by a single person; and (b) means for suspending a ball from the support arm at a location sufficiently spaced away from said support arm one end to allow the ball to serve as a target for a user attempting to hit the ball.

2. A batting practice device as recited in claim 1, wherein the flexible member comprises a chain.

3. A batting practice device, which comprises:

(a) an elongated support arm for abutting against a generally vertical post, means carried on one end of said support arm for securing said arm to said post in a cantilever manner, wherein the securing means comprises:

(i) a flexible member, attachment means on said support arm for engaging one end of said flexible member, the remaining portion of said flexible member extending around the post and back to the support arm;

(ii) means on said support arm for releasably retaining the other end of the flexible member therein to prevent the flexible member from sliding relative to the support arm; and (iii) said attachment means on the support arm includes adjustment means for drawing the flexible member inwardly relative to the support arm after the flexible member has been looped around the post and had said one end placed in said means for releasably retaining to thereby tighten the flexible member to the post and for holding the flexible member in this tightened condition; and (b) means for suspending a ball from the support arm at a location sufficiently spaced away from said support arm one end to allow the ball to serve as a target for a user attempting to hit the ball.

4. A batting practice device as recited in claim 3, wherein the said means for releasably retaining comprises an elongated open faced slot in the support arm into which said other end of the flexible member is laid, said flexible member having an enlarged portion, and wherein the slot includes abutment means for engaging said enlarged portion of the flexible member to prevent the flexible member from sliding in the slot.

5. A batting practice device as recited in claim 4, wherein the open faced slot is placed in an end face of the support arm.

6. A batting practice device as recited in claim 5, wherein the flexible member comprises a chain having pairs of chains links pivotally connected together end-to-end by pivot pins, wherein adjacent link pairs have different thicknesses with a thin link pair being placed between adjacent thick link pairs, and wherein the abutment means in the slot comprises a slot section of reduced width sized to receive therein a thinner link pair with the adjacent thicker link pairs on each side of the thinner link pair abutting against the reduced width slot section.

7. A batting practice device as recited in claim 6, wherein the slot extends in the end face of the support arm with the reduced thickness slot section being located at the junction between the end face and a rear face of the support arm, whereby the chain extends out of the slot and is sufficiently long such that its first end hangs outwardly from the support arm.

8. A batting practice device as recited in claim 7, wherein the rear face of the support arm includes a vertical slot for receiving one of the pivot pins of the chain for further retaining the chain against a sliding movement relative to the slot.

9. A batting practice device as recited in claim 3, wherein said adjusting means comprises:

(a) a threaded bolt fixed to said one end of the flexible member;

(b) a handle threaded on the bolt and suited to bear against the support arm, whereby rotation of the handle draws the bolt inwardly into the handle to tighten the flexible member against the post.

10. A batting practice device as recited in claim 9, wherein the bolt extends through the support arm to have a free end located in back of a rear face of the support arm, and wherein the handle is threaded onto the free end of the bolt and abuts against the rear face of the support arm.

11. A batting practice device as recited in claim 3, wherein said securing means further comprises a saddle member suited to abut against one side of the post.

12. A batting practice device as recited in claim 3, wherein the ball suspension means is located on the other end of the support arm.

13. A batting practice device as recited in claim 12, wherein the ball suspension means comprises:

(a) an elongated cord having one end secured to the ball;

(b) cord retaining means having an eyelet at the other end of the cord;

(c) an outwardly extending stud member at the other end of the support arm, the stud member having an inner, smooth cylindrical bearing surface and an outer threaded portion, wherein the eyelet is received on said bearing surface for rotation of the ball and cord in a vertical plane therearound; and (d) a fastening member threaded onto the outer threaded portion of the stud for releasably holding said cord retaining means on the stud member.

14. A batting practice device as recited in claim 13, wherein the fastening member is provided with a plurality of outwardly extending wings to allow the fastening member to be tightened and untightened by hand.

15. A batting practice device as recited in claim 3, wherein the flexible member comprises a chain.

* * * * *